United States Patent [19]

Le Chatelier

[11] 4,316,357

[45] Feb. 23, 1982

[54] METHOD AND DEVICE FOR WINDING YARN ONTO BOBBINS IN THE FORM OF CONES IN SPINNING FRAMES

[75] Inventor: Jacques Le Chatelier, Riedisheim, France

[73] Assignee: Societe Alsacienne de Constructions Mechaniques, Mulhouse, France

[21] Appl. No.: 146,640

[22] Filed: May 5, 1980

[30] Foreign Application Priority Data

May 17, 1979 [FR] France ..... 79 12564

[51] Int. Cl.[3] ..... D01H 1/36; D01H 7/56

[52] U.S. Cl. ..... 57/95; 57/75; 57/98; 57/124; 242/26.1

[58] Field of Search ..... 57/75, 95, 98, 124, 57/119; 242/26.1–26.4, 26.45, 26.5

[56] References Cited

U.S. PATENT DOCUMENTS

| | | | |
|---|---|---|---|
| 3,636,696 | 1/1972 | Howe et al. | 57/95 |
| 3,665,696 | 5/1972 | Gubinsky et al. | 57/95 X |
| 3,702,528 | 11/1972 | Hartley, Jr. | 57/75 |
| 3,768,244 | 10/1973 | Yasutomi et al. | 57/95 X |
| 4,023,342 | 5/1977 | Schenkel | 57/75 X |

*Primary Examiner*—John Petrakes

*Attorney, Agent, or Firm*—McDougall, Hersh & Scott

[57] ABSTRACT

The method for winding yarn in the form of a cone onto a bobbin carried by a spindle in a spinning or twisting frame consists in passing the yarn to be wound through a traveler mounted on a revolving ring, in lifting and lowering the ring cyclically around the bobbin in order to form the winding cone, and in producing a cyclic variation in the spindle speed in accordance with the cycle of up-and-down motion of the ring support plate.

9 Claims, 4 Drawing Figures

METHOD AND DEVICE FOR WINDING YARN ONTO BOBBINS IN THE FORM OF CONES IN SPINNING FRAMES

The present invention relates to the textile industry and is directed to a method and device for winding-on which are applicable to revolving-ring spinning machines.

It is known that, in machines such as spinning or twisting frames, the yarn delivered by the exit rollers of the machine is wound onto bobbins carried by spindles as it passes through a traveler slidably mounted on a ring which surrounds the spindle. In order to form winding cones on bobbins in the conventional manner, all the rings of a frame are mounted on a ring support plate to which is imparted a relatively rapid reciprocating movement and an associated continuous low-speed upward movement.

In all machines of this type, it has been sought to increase production by increasing the speed of rotation of the spindles but this has been limited by the increase in the mean tension exerted on the yarn and by wear of the traveler on the ring. A further limitation arises from the cyclic variations in yarn tension produced by winding in a cone. In point of fact, the diameter of winding on the bobbin varies from the apex of the cone to the base in a ratio of the order of 1 to 2, for example. This results in cyclic variations in the driving torque of the traveler and consequently in the yarn tension. These periodic variations in tension have a harmful effect on the balloon as well as the homogeneity of the bobbin and are liable to cause yarn breakages.

An attempt has been made to overcome these variations in yarn tension in fixed-ring spinning frames of conventional types. It has thus been proposed to produce a cyclic variation in the speed of rotation of spindles when the yarn wound upon the bobbin passes onto the base of the winding cone or onto the point, the period of variation in speed of the spindle being equal to the period of travel of the ring support plate.

But it has been found that, in order to obtain appreciable regularization of the yarn tension, substantial speed variations would have to be applied to the spindle (for example 20 to 35% in the case of speeds of the order of 6 or 8,000 rpm, with a period of the order of 5 to 15 seconds), which cannot readily be achieved in practice. However, if smaller variations in spindle speed are considered sufficient, then the gain in regularization of yarn tension is very small and does not in fact justify the complication and cost of mounting a speed-changing unit on the spindles. In general, this solution has therefore been abandoned or seldom adopted and even then only in the case of relatively low spindle speeds since it is wholly apparent that this solution is more difficult to carry into practical effect as the spindle speed is higher by reason of the fact that these machines have high moments of inertia.

It has therefore been sought for a number of years to increase the spindle speed by having recourse to other means for avoiding an unacceptable increase in yarn tension. The design solution now proposed for spinning frames accordingly consists in making use of revolving spinning rings instead of stationary rings, in particular spinning rings mounted on pneumatic bearings. By virtue of the high degree of mobility of the pneumatic bearing, the traveler which is driven in rotation by the thread in turn drives the revolving ring by frictional contact. During operation, the difference in speed between the traveler and the ring is consequently very small (or even zero) and the wear of the traveler is therefore very slight, thus permitting the use of lightweight, low-friction travelers which therefore produce low tension on the yarn. Revolving spinning-ring devices of this type have been described in French patent applications No 78 08 635 filed on Mar. 24th, 1978 and No 78 13 619 filed on May 9th, 1978.

By making use of revolving spinning rings and especially rings mounted on pneumatic bearings, it has been possible to increase spinning speeds to 12,000 or 15,000 rpm, for example, while maintaining acceptable values of yarn tension.

It will be readily apparent, however, that the problem of cyclic variations in tension noted in the foregoing in connection with conventional fixed spinning rings and resulting from winding of yarn in the form of cones also exists in the case of revolving-ring spinning. It is this problem which the present Applicant has endeavored to solve.

In principle, it seemed wholly impracticable to make use of the system already proposed in which a cyclic speed variation is applied to the spindles in synchronism with the up-and-down motion of the ring support plate since this system failed to produce satisfactory results at ordinary spinning speeds such as 8,000 rpm, for example.

However, the present Applicant has reached the surprising conclusion that satisfactory regularization of the yarn tension can be obtained by combining revolving rings (especially rings mounted on fluid bearings) with a system for producing cyclic variation of the spindle speed in a spinning frame or a similar machine, this result being achieved with much smaller variations in spindle speed than those which are necessary in the case of fixed-ring spinning, the variations thus permitted being of the order of 2 to 10%.

The invention is directed to a method for winding yarn in the form of a cone onto a bobbin carried by a spindle in a spinning or twisting frame, said method being distinguished by the fact that it consists in passing the yarn to be wound through a traveler mounted on a revolving ring, in lifting and lowering the ring cyclically around the bobbin in order to form the winding cone, and in producing a variation in the spindle speed according to the same cycle between a minimum speed and a maximum speed within the range of 1.02 to 1.10 times the minimum speed, depending on whether the yarn is wound on the region of the cone apex or on the region of the cone base.

The invention is further directed to a device for winding yarn in the form of a cone onto a bobbin carried by a spindle driven in rotation in a spinning or twisting frame, of the type which comprises a traveler ring surrounding the spindle and mounted on a ring support plate to which is imparted a vertical reciprocating movement. Said device is distinguished by the fact that the traveler ring is a revolving ring, that provision is made for a speed-changing unit in the kinematic chain for driving the spindle in rotation, that the speed-changing unit is coupled with the ring support plate for driving the spindle at maximum speed when the traveler is located at a height in the vicinity of the base of the cone and at minimum speed when the traveler is at a height located in the vicinity of the apex of the cone, and that the speed-changing unit has a range of variation between 1 to 1.02 and 1 to 1.10.

As an advantageous feature, the cycle of spindle-speed variation is displaced with respect to the cycle of up-and-down motion of the ring by a time interval t within the range of 0.05 to 0.35 times the duration of the cycle.

These and other features of the invention will be more apparent on consideration of the following description and accompanying drawings in which one embodiment of the invention is shown by way of example but not in any limiting sense, and in which.

Figure 1:
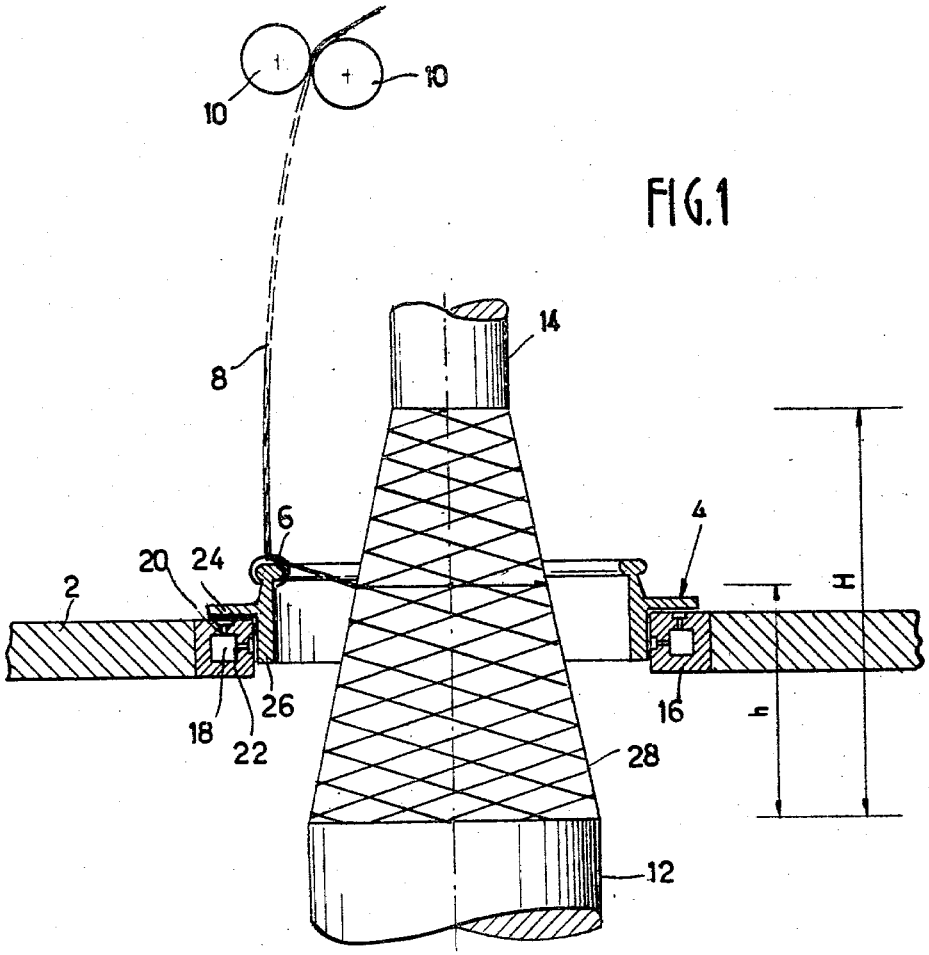
FIG. 1 is a side view of a bobbin during winding of yarn in the form of a cone by means of a revolving-ring traveler.

There is shown in FIG. 1 the ring support plate 2 of a spinning frame or like machine on which are mounted revolving rings 4, each ring being adapted to carry a sliding traveler 6 through which the yarn 8 supplied by the delivery rollers 10 of the machine is intended to pass. After passing through the traveler 6, the yarn is wound onto the bobbin 12, the tube 14 of which is carried by the spindle (not shown) of the machine.

Preferably, the revolving ring 4 is a ring mounted on a pneumatic bearing such as, for example, an aerostatic bearing comprising a stator 16 rigidly fixed to the ring support plate 2 and enclosing a compressed-air feed duct 18. The compressed air escapes through nozzles 20–22 in order to form in conjunction with the opposite portions 24–26 of the revolving ring 4 a sustentation air cushion for lifting and centering the ring in its bearing. The ring is driven in rotation by frictional contact of the traveler with the ring, the traveler being in turn driven in rotation by the yarn.

Figure 3:
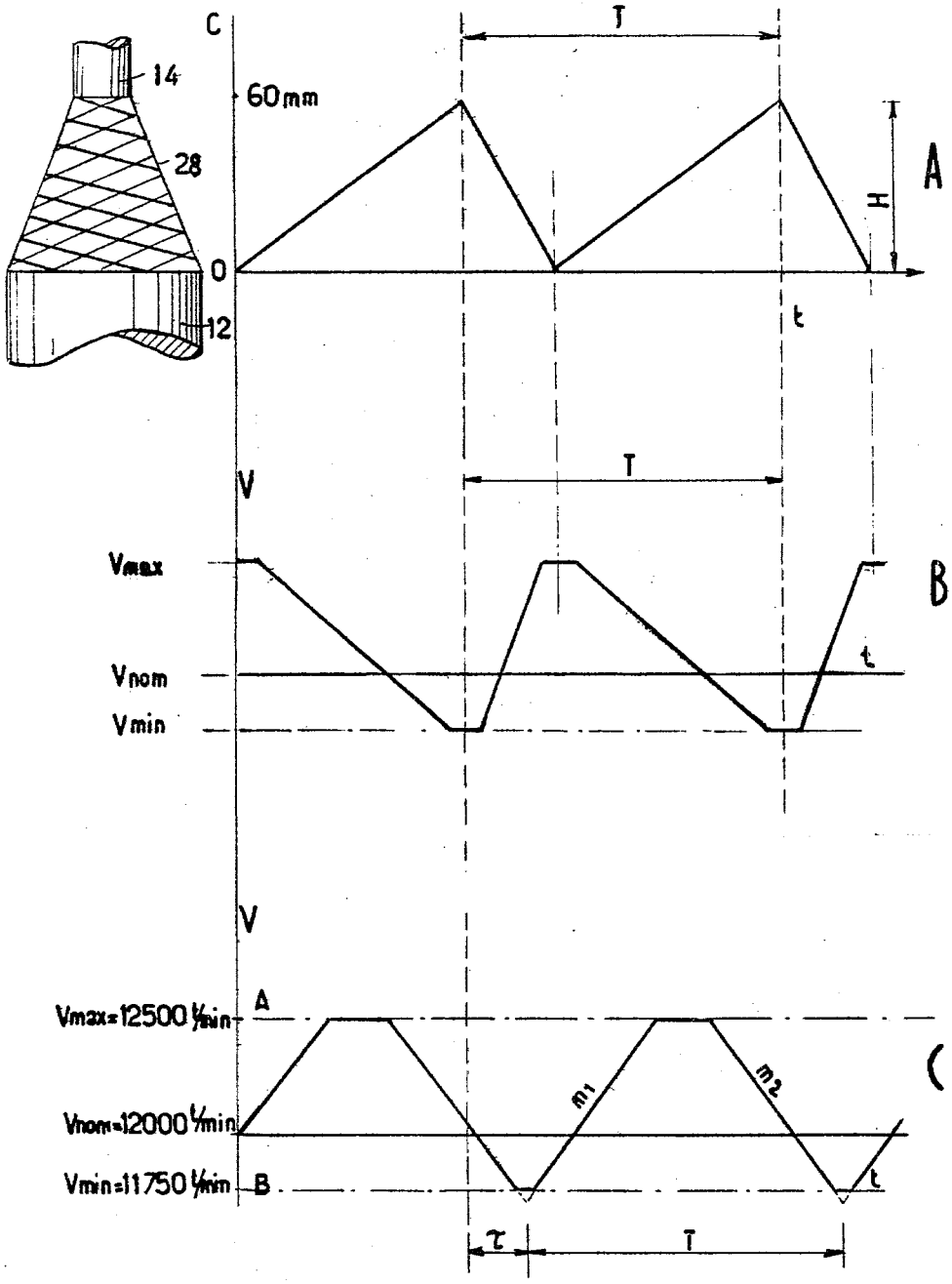
FIG. 3 is a diagram of the displacements of the ring support plate as a function of time and of variations in spindle speed as a function of time.

In order to form the winding cone 28 of the yarn 8 on the bobbin 12, the ring support plate 2 is driven (by conventional means not shown in the drawings) in an up-and-down reciprocating movement at relatively high speed (for example with a period of 5 to 20 seconds) and with an amplitude H. The portion A of FIG. 3 shows the diagram of displacements of the ring support plate as a function of time.

As is also the case in conventional practice, the ring support plate is driven at the same time in an upward movement at low speed (for example over a period of one hour) in order to ensure that the winding-on operation takes place over the entire height of the tube 14 of the bobbin 12.

Figure 2:
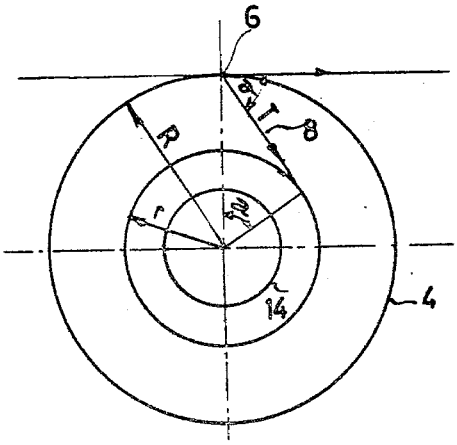
FIG. 2 is an end view of the same bobbin and of the ring.

It is apparent from FIGS. 1 and 2 that the relation between the tension T of the yarn 8 and the driving torque C of the traveler produced by the yarn depends on the winding radius r. In other words, this relation varies as a function of the height h of the traveler and therefore of the ring support plate.

In fact, if R is the radius of the ring and r is the winding radius in respect of the height h, we have:

$$C=T \cos \alpha R; \cos \alpha = r/R; C=T r$$

In point of fact, the radius r can vary in the ratio of 1 to 2 or 1 to 3 between the apex and the base of the cone.

The cyclic variations in tension applied to the yarn as a result of winding-on in the form of a cone can be considerably reduced by means of the invention by producing a cyclic variation in the spindle speed as a function of the height of the ring support plate as shown in portion B of FIG. 3 which is a theoretical diagram of the spindle speed as a function of time.

In this theoretical diagram, the period T of variation in spindle speed is equal to the period T of the movements of the ring (diagram A) and these two cyclic variations are in phase. In other words, the maximum speed of the spindle corresponds substantially to winding of the yarn onto the base of the cone and the minimum speed corresponds to winding of the yarn onto the apex of the cone.

In accordance with an important feature of the invention, a phase shift or relative displacement $\tau$ is applied between these two variations as shown in the diagram C of FIG. 3 so that the origin of the period of variation in spindle speed is shifted forward in time with respect to the origin of the period of movement of the ring.

This relative displacement $\tau$ is preferably adjustable as a function of the different spinning factors and can be within the range of 0.05 to 0.35 times the duration T of the cycle. In the diagram C of FIG. 3, this relative displacement is approximately 0.17 T.

A surprising result achieved by the invention is that the required difference between the minimum speed and the maximum speed of the spindle is much smaller than that which would be necessary in the case of a conventional fixed-ring spinning frame. In the case, for example, of a nominal spindle speed of 12,000 rpm, it is indicated in diagram C of FIG. 3 that the minimum speed can be 11,750 rpm and the maximum speed can be 12,500 rpm. In other words, the maximum speed is only 1.065 times the minimum speed. It has been possible to establish that, depending on the different factors involved (nominal spindle speed, quality of yarn and so forth), satisfactory results are obtained with a speed difference within the range of 1.02 to 1.10.

It has been possible to determine that, under that same conditions, the speed variation which would be necessary in order to obtain similar results with fixed rings would be approximately three times higher in respect of equal mean spindle speeds.

Figure 4:
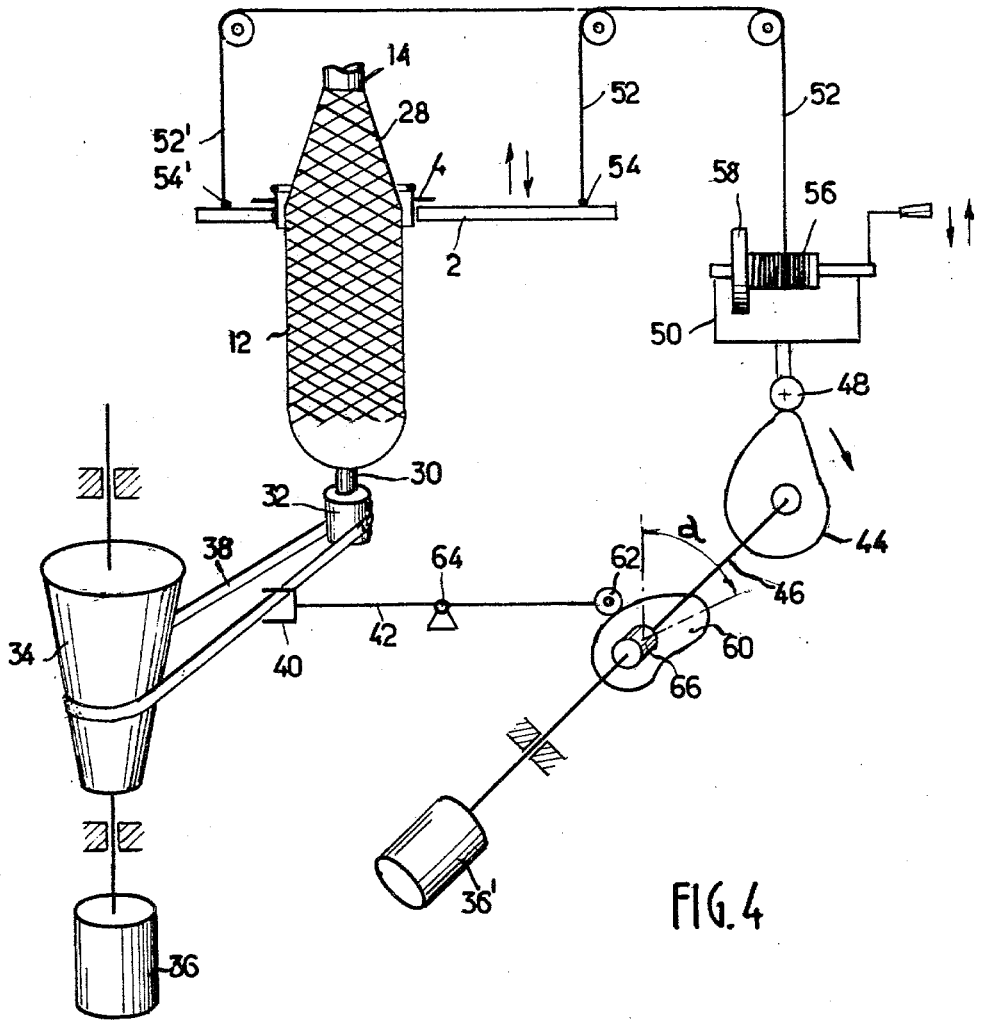
FIG. 4 is a schematic view showing the different components of a device according to the invention.

FIG. 4 is a schematic illustration of the essential elements of a device for carrying out the invention.

FIG. 4 shows the elements which have already been described with reference to FIG. 1, namely the ring support plate 2, the revolving ring 4 and the bobbin 12, the tube 14 of which is driven by a spindle 30 which is adapted to carry a pulley 32, the speed of rotation of which is higher than 8,000 rpm, for example. A speed-changing unit is provided in the kinematic chain for driving the spindle in rotation and is represented schematically in the form of a cone 34 driven by a motor 36, a driving belt 38 being passed around said cone and around the pulley 32.

The member for controlling the speed-changing unit is constituted by a fork carried by an arm 42. It will be apparent that only one speed-changing unit would be provided on one spinning base for all the spindles. The speed-changing unit can consist of any conventional device such as a variable-speed motor, for example.

The cyclic up-and-down movement of the ring support plate 2 as well as the associated low-speed upward movement of said ring support plate are performed by means of any conventional mechanism employed in spinning or twisting frames.

In accordance with the schematic presentation of FIG. 4, these movements can be controlled by a cam 44 keyed on a shaft 46 driven by a motor 36' which is preferably the main motor 36 of the machine.

Since lifting and lowering mechanisms for producing up-and-down motion are well-known, it is only necessary to mention that the cam 44 lifts and lowers a roller 48 carried by a moving system 50 to which is coupled one or a number of cables 52—52', the ends 54—54' of which are attached to the ring support plate 2. On the moving system 50, the cable 52 is wound onto a driving winch 56 by means of a ratchet mechanism 58 which winds-on the cable and thus carries out the slot upward movement of the ring support plate in conjunction with its rapid up-and-down movement.

In accordance with the invention, the control member 42 of the speed-changing unit is coupled to the ring support plate. In the embodiment shown in FIG. 4, the member 42 is coupled to the cam 44 which reproduces the movements of the support plate.

To this end, a second cam 60 is mounted on the shaft 46 of the cam 44 so as to cooperate with a roller 62 carried by that end of the arm 42 which is remote from the fork 42 with respect to the axis 64 of pivotal motion of said arm.

The range of speed variation of the speed-changing unit (and therefore the conicity of the cone 34 in the case of FIG. 4) is limited in accordance with the invention since a ratio of 1 to 1.1 is sufficient.

Finally, in the coupling between the control member of the speed-changing unit and the member for controlling the movements of the ring support plate, provision is made for relative-displacement or phase-shifting means.

In the case of FIG. 4, said means can readily consist of adjustable means for setting the cam 60 on the shaft 46. By way of example, use can be made of a hub 66 for adjusting the relative angular setting of the two cams 60 and 54 over a setting range having an angle $\alpha$ (approximately 120°, for example) in order to adjust the relative displacement between the origins of the cycles of motion of the ring support plate and of the variation in spindle speed. Said relative displacement can attain approximately 0.35 times the duration of the cycle T.

What is claimed is:

1. A method for winding yarn in the form of a cone onto a bobbin carried by a spindle in a spinning or twisting frame, wherein said method consists in passing the yarn to be wound through a traveler mounted on a revolving ring, in lifting and lowering the ring cyclically around the bobbin in order to form the winding cone, said method including the step of varying the spindle speed in relation to the lifting and lowering of the ring with a relative forward displacement in time, between a minimum speed when the yarn is wound onto the apex of the cone and a maximum speed within the range of 1.02 to 1.10 times the minimum speed when the yarn is wound onto the base of the cone.

2. A method according to claim 1, wherein the mean spindle speed under normal operating conditions is higher than 8,000 rpm.

3. A method according to claim 1 or claim 2, wherein the relative displacement of the cycle of variation in spindle speed with respect to the cycle of up-and-down movement of the ring represents a time interval t within the range of 0.05 to 0.35 times the duration of the cycle.

4. In a device for winding yarn in the form of a cone onto a bobbin carried by a spindle driven in rotation in a spinning or twisting frame, a traveler ring surrounding the spindle and mounted on a ring support plate, means for imparting a vertical reciprocating movement to the support plate, said traveler ring being a revolving ring, driving means including a speed-changing unit for driving the spindle in rotation, the improvement which comprises means coupling the speed-changing unit with the ring support plate, in which the speed-changing unit is responsive to the height of the traveler for driving the spindle at a speed which varies between 1 to 1.02 and 1 to 1.10 with the maximum speed when the traveler is located at a height in the vicinity of the base of the cone and at minimum speed when the traveler is located at a height in the vicinity of the apex of the cone, and wherein the means for coupling the ring support plate with the speed-changing unit control means provides a relative time displacement or phase shift between the end positions of said ring support plate and the end positions of said speed-changing unit control means.

5. A device according to claim 4, wherein the revolving ring is a ring mounted on a pneumatic fluid bearing.

6. A device according to claim 5, wherein the ring is freely mounted for rotation in the pneumatic bearing and wherein said ring is driven in rotation solely under the action of frictional contact of the traveler with said ring.

7. A device according to claim 4, wherein the aforesaid relative time displacement is within the range of 0.05 to 0.35 times the duration of the cycle of variation.

8. A device according to claim 4, wherein adjustment means are provided for adjusting the relative displacement aforesaid.

9. A device according to claim 4, wherein the mean speed of rotation of the spindle during operation is higher than 8,000 rpm.

* * * * *